US007511235B2

(12) United States Patent
Osada

(10) Patent No.: US 7,511,235 B2
(45) **Date of Patent: *Mar. 31, 2009**

(54) ELECTRONIC APPARATUS

(75) Inventor: Yoichi Osada, Yokohama (JP)

(73) Assignee: Canon Kabushiki Kaisha (JP)

( * ) Notice: Subject to any disclaimer, the term of this patent is extended or adjusted under 35 U.S.C. 154(b) by 17 days.

This patent is subject to a terminal disclaimer.

(21) Appl. No.: 11/937,609

(22) Filed: Nov. 9, 2007

(65) Prior Publication Data

US 2008/0067041 A1 Mar. 20, 2008

Related U.S. Application Data

(62) Division of application No. 11/672,744, filed on Feb. 8, 2007, now Pat. No. 7,312,411.

(30) Foreign Application Priority Data

Feb. 9, 2006 (JP) ..... 2006-032412

(51) Int. Cl.
*H01H 19/00* (2006.01)
*H01H 21/00* (2006.01)

(52) U.S. Cl. ..... 200/6 A; 200/1 R; 200/5 R

(58) Field of Classification Search ..... 200/6 A
See application file for complete search history.

(56) References Cited

U.S. PATENT DOCUMENTS 5,294,758 A 3/1994 Frankhouse et al.
5,561,278 A 10/1996 Rutten
5,564,560 A 10/1996 Minelli et al.
6,437,682 B1 * 8/2002 Vance ..... 338/185
6,667,447 B2 * 12/2003 Liu et al. ..... 200/5 R
6,844,511 B1 * 1/2005 Hsu et al. ..... 200/6 A
6,914,203 B2 * 7/2005 Suzuki ..... 200/6 A
7,189,932 B2 * 3/2007 Kim ..... 200/5 R
7,297,883 B2 * 11/2007 Rochon et al. ..... 200/5 R
7,312,411 B2 * 12/2007 Osada et al. ..... 200/6 A
7,442,886 B2 * 10/2008 Hashida ..... 200/5 R

FOREIGN PATENT DOCUMENTS

JP 8-88883 A 4/1996
JP 2005-197037 A 7/2005

* cited by examiner

*Primary Examiner*—Elvin G Enad
*Assistant Examiner*—Lheiren Mae A Anglo
(74) *Attorney, Agent, or Firm*—Rossi, Kimms & McDowell, LLP

(57) ABSTRACT

Electronic apparatus that can be disposed in a small space and allows multidirectional input without impairment of a click feeling. A cross key including a plurality of pins is elastically held by an operating member holding mat including a plurality of holes into which the respective pins are insertable. An analog switch overlapped on the operating member holding mat outputs a signal when one of the pins comes into direct contact with the analog switch in response to operation of the cross key. A metallic dome sheet overlapped on the analog switch outputs a signal when one of the pins comes into contact with the metallic dome sheet via the analog switch in response to operation of the cross key. The metallic dome sheet outputs a signal after the analog switch outputs a signal.

7 Claims, 5 Drawing Sheets

ELECTRONIC APPARATUS

This is a divisional of U.S. patent application Ser. No. 11/672,744 filed Feb. 8, 2007.

BACKGROUND OF THE INVENTION

1. Field of the Invention

The present invention relates to an electronic apparatus that operates an image pickup apparatus such as a digital still camera.

2. Description of the Related Art

In recent years, while image pickup apparatuses such as digital still cameras have become miniaturized, there have been many cases where the main body of an image pickup apparatus is equipped with a large image output screen, and therefore the space for operating members disposed in plane with an image output screen has become smaller. In particular, disposing a cross key requiring an arc space has become increasingly difficult, and the space for the placement of such a cross key has decreased. On the other hand, with increases in the capabilities of image pickup apparatuses, the demand for multi-input devices has been rising.

Under such circumstances, there has been proposed a multidirectional cross key which allows input in eight directions; not only left, right, up, and down directions as in the case of conventional cross keys but also left up, right up, left down, and right down directions (see Japanese Laid-Open Patent Publication (Kokai) H08-088883, for example). There has also been proposed a multidirectional cross key which allows 17 different inputs using a central button as well as a multidirectional cross key which allows input in eight directions.

The above multidirectional cross key, however, has the problem that the number of switches on the same plane is increased so as to allow multidirectional input, and therefore, the arrangement of the key is difficult if the space is tight. Also, the above multidirectional cross key has the problem that complicated operations such as simultaneous depression of three switches, i.e. a right switch, an upper switch, and a central are required, which results in a significant degradation in the ease of operation.

To address such problems, there has been proposed a multidirectional input cross key in which a plurality of switches are placed one on top of another in the direction in which an operating member is pressed so that an increase in the space for the placement of switches can be prevented (see Japanese Laid-Open Patent Publication (Kokai) No. 2005-197037, for example). Specifically, this multidirectional input cross key has conductive rubber around the center of the operating member, and a metallic dome is disposed under the conductive rubber. The metallic dome is a thin conductive dome-shaped plate that projects downward and serves as a switch. When the operating member is depressed, the conductive rubber is brought into contact with an analog circuit pattern corresponding to the conductive rubber at a pressure according to the amount of operation. At the same time, the metallic dome combined with a digital circuit pattern is inverted and deformed to come into abutment with projections inside a concave formed in the bottom of a case, so that a digital signal is generated. This gives the operator a click feeling (operational feeling) when he/she confirms operation.

The above-described multidirectional input button, however, has the problem that an operator presses the metallic dome via the conductive rubber when depressing the operating member, and therefore a click feeling given to the operator is seriously impaired.

SUMMARY OF THE INVENTION

It is an object of the present invention to provide electronic apparatus that can be disposed in a small space and allows multidirectional input without impairment of a click feeling.

To attain the above object, in an aspect of the present invention, there is provided Electronic apparatus comprising an operating member including a plurality of pins, a holding member that elastically holds the operating member, the holding member including a plurality of holes into which respective ones of the plurality of pins is insertable, a first switch that is overlapped on the holding member and outputs a signal when one of the plurality of pins comes into direct contact with the first switch in response to operation of the operating member, and a second switch that is overlapped on the first switch and outputs a signal when one of the plurality of pins comes into contact with the second switch via the first switch in response to operation of the operating member, the second switch outputting a signal after the first switch outputs a signal.

Preferably, the holding member elastically holds the operating member in an unoperated state, and the operating member is operated against elastic force of the holding member.

Preferably, the first switch includes a metallic plate and a carbon layer arranged to be spaced from the metallic plate, and any of the plurality of pins coming into contact with the carbon layer brings the metallic plate and the carbon layer into contact with each other so that a signal is output.

More preferably, the first switch outputs different signals depending on positions at which the metallic plate and the carbon layer are in contact with each other.

More preferably, the operating member includes a rib-shaped portion formed in alignment with the plurality of pins, the carbon layer includes a carbon portion shaped like a circumference of a circle, and the operating member is disposed so that the rib-shaped portion comes into contact with a break in the circumferential shape of the carbon portion.

Preferably, second switch includes a dome portion that becomes elastically deformed, and any of the plurality of pins coming into contact with the dome portion via the first switch causes the dome portion to become elastically deformed.

According to the present invention, electronic apparatus that can be arranged in a small space and allows multidirectional input without impairment of a click feeling (operational feeling) at the time of operation.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
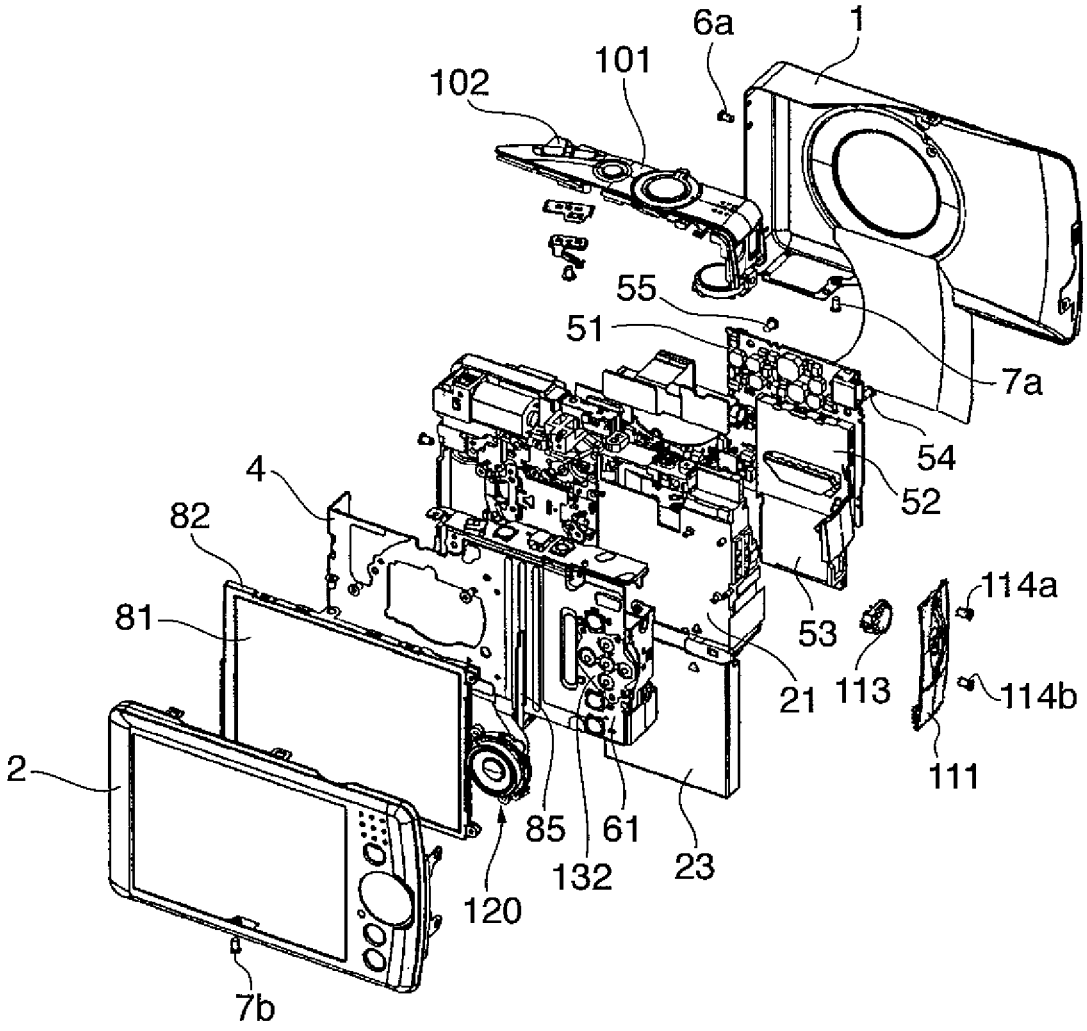
FIG. 1 is an exploded perspective view showing a camera with electronic apparatus according to an embodiment of the present invention.

FIG. 1 is an exploded perspective view showing a camera with electronic apparatus according to an embodiment of the present invention.

In FIG. 1, reference numeral 1 denotes a front cover that covers a front side of the camera; 2, a back cover that covers a back side of the camera 2; and 4, a metallic chassis. A zoom motor and a gear unit for driving a lens barrel are integrally mounted on the metallic chassis 4, and a lens barrel unit, not shown, holding taking lenses is fixed to the metallic chassis 4 by lens barrel fixation screws. Reference numeral 21 denotes a battery case for holding a battery 23. The battery case 21 is fixed to the metallic chassis 4 by battery case fixation screws 22*a* and 22*b*.

Reference numeral 51 is a main wiring board on which a CPU, memory, image processing LSI, power supply circuit, etc. are mounted. A slot 52 of a memory card 53, which is an external memory for storing images and sounds, and a USB connector 54 are mounted on a back side of the main wiring board 51. The main wiring board 51 is fixed to the metallic chassis 4 by main wiring board fixation screws 55*a*, 55*b*, and 55*c*.

An operation flexible wiring board 61 is mounted on the metallic chassis 4. A release switch, a power switch, etc. are mounted on the operation flexible wiring board 61, and a metallic dome sheet 132 is fixed to the operation flexible wiring board 51 by an adhesive material. An operation button device 120 including the metallic dome sheet 132 is mounted on the operation flexible wiring board 61.

Reference numeral 81 is a liquid crystal panel that is covered with a liquid crystal cover 82 so that the liquid crystal panel 81 and a back light, not shown, provided on a back surface of the liquid crystal cover 81 constitute one unit. The unit comprised of the liquid crystal panel 81 and the back light is fixed to the metallic chassis 4 by liquid crystal fixation screws, not shown. Reference numeral 85 denotes a reinforcing plate that is intended to protect the liquid crystal panel 81 from external pressure.

Reference numeral 101 is an upper cover that holds a camera operation mode-switching lever 102 and also holds a zoom lever, release button, power button, etc., not shown. The upper cover 101 is disposed on an upper side of the battery case 21 in such a manner that the upper cover 101 and the battery case 21 sandwich the operation flexible wiring board 61. A side cover 111 is fixed to the front cover 1, back cover 2, and metallic chassis 4 by side cover screws 114*a* and 114*b* in such a manner that the side cover 111 and metallic chassis 4 sandwich an inner member 113. The front cover 1 and the back cover 2 are fixed to a side surface of the metallic chassis 4 by side surface fixation screws 6*a* and 6*b* and fixed to a bottom surface of the metallic chassis 4 by bottom surface fixation screws 7*a* and 7*b*.

Figure 2:
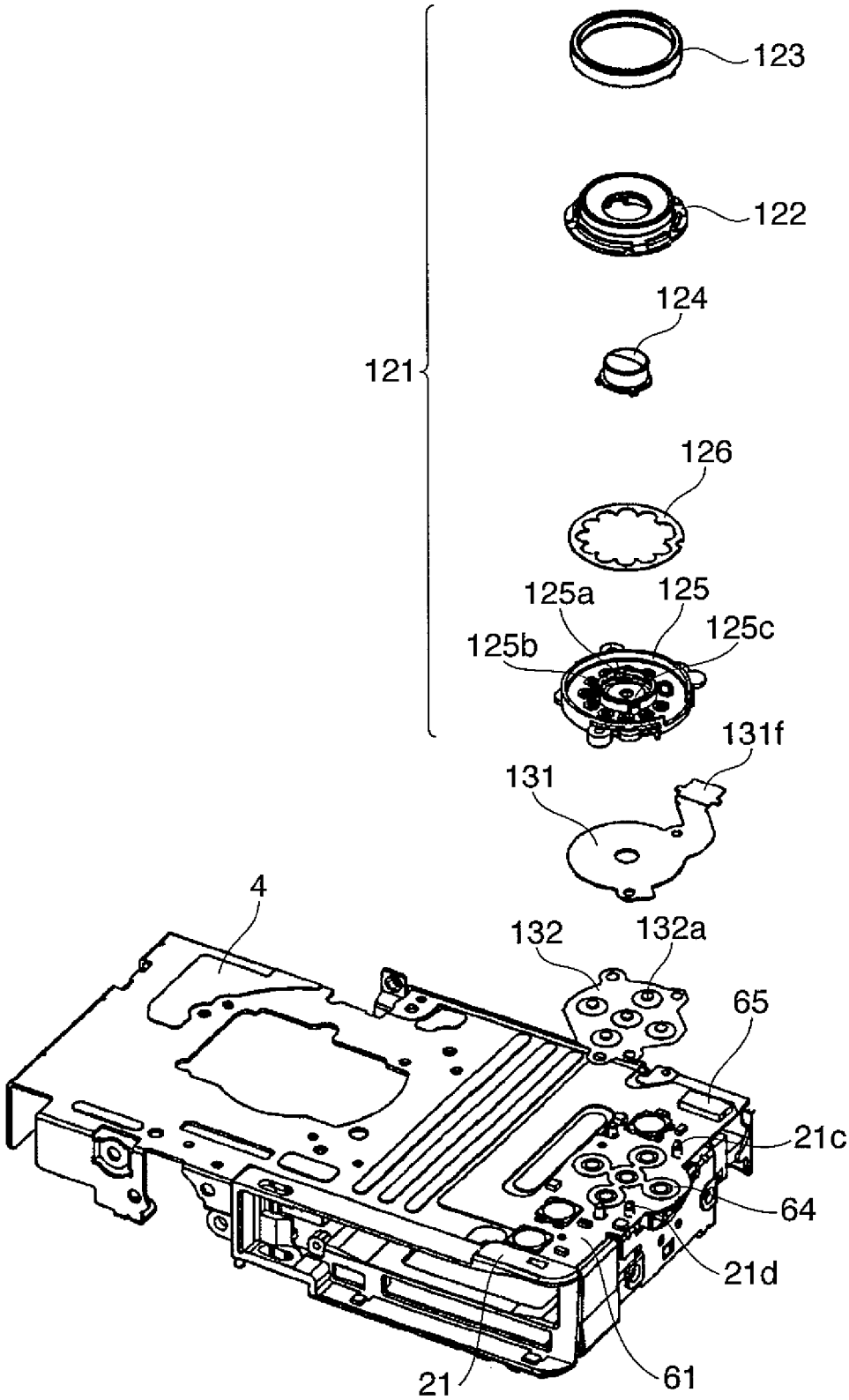
FIG. 2 is an exploded perspective view showing an upper side of the electronic apparatus appearing in FIG. 1.
Figure 3:
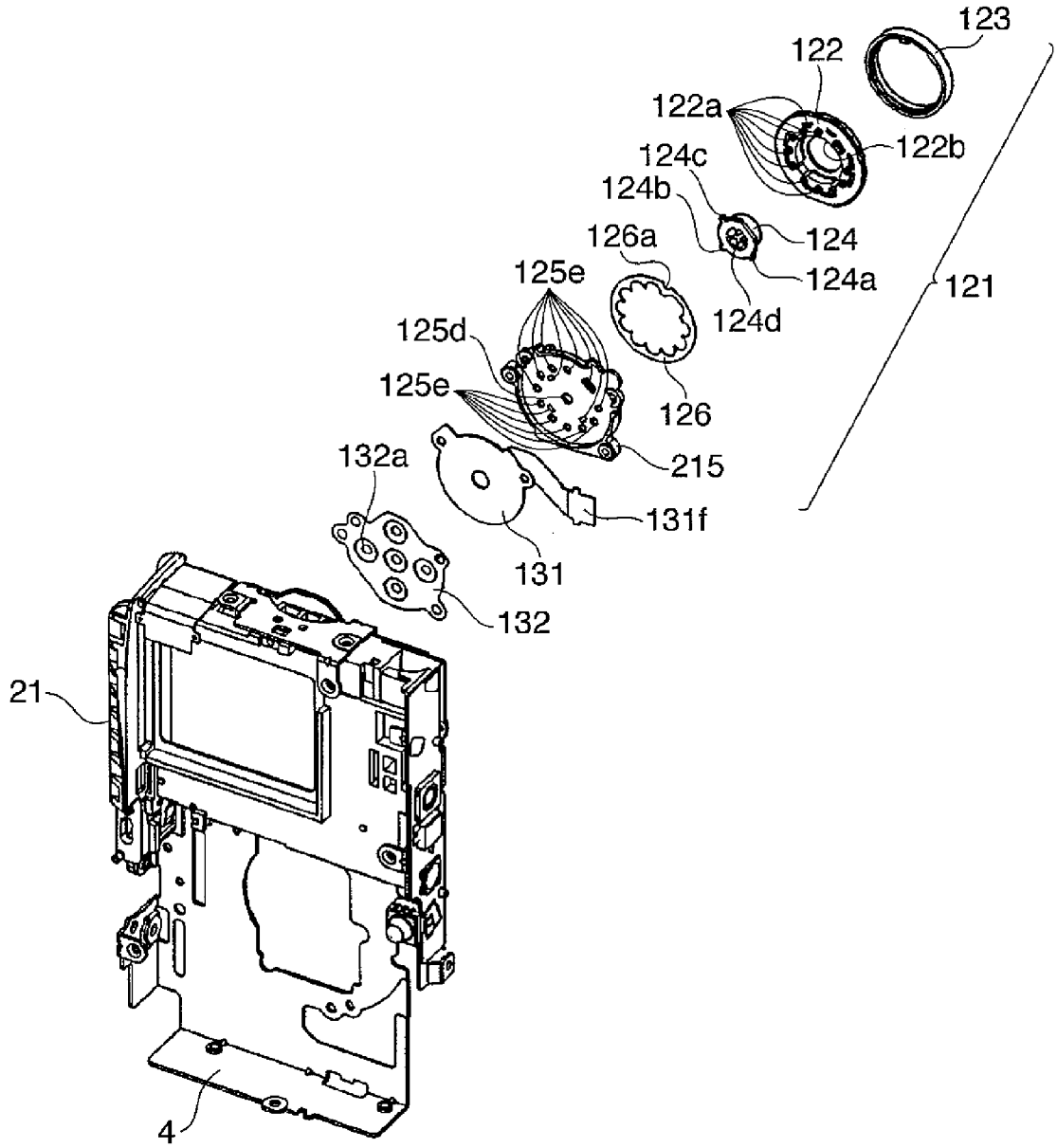
FIG. 3 is an exploded perspective view showing a back side of the electronic apparatus appearing in FIG. 1.
Figure 4:
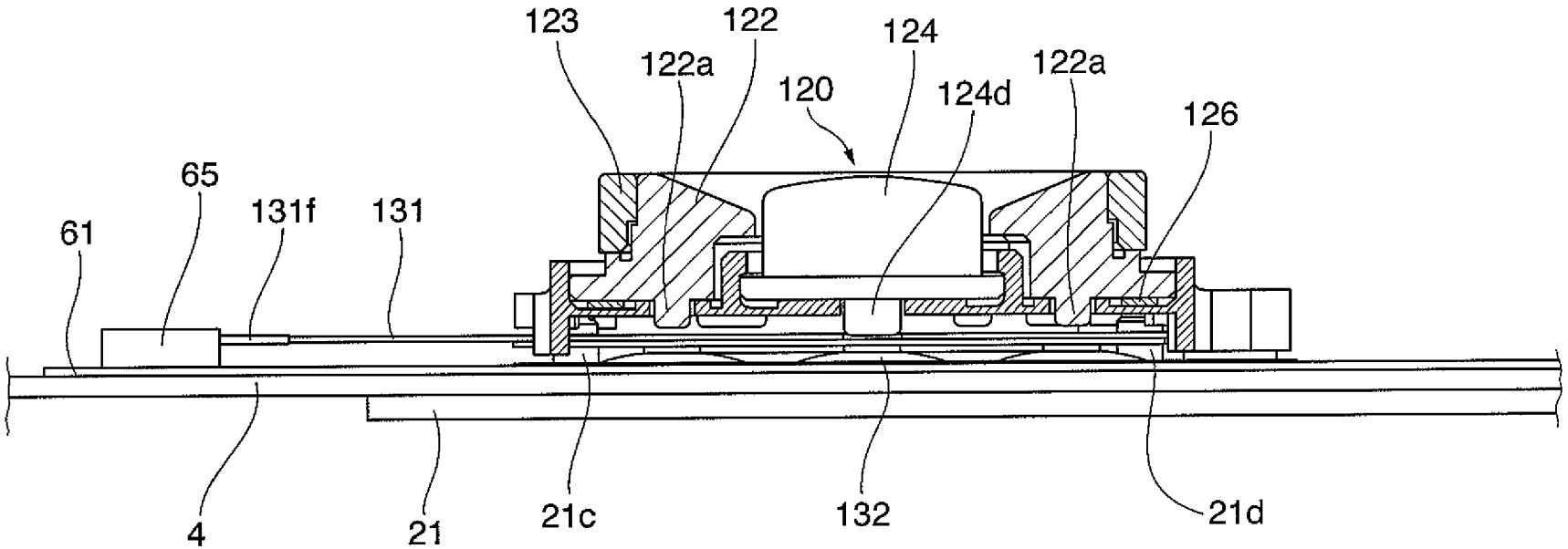
FIG. 4 is a sectional view showing the electronic apparatus appearing in FIG. 1.

Referring next to FIGS. 2, 3, and 4, a detailed description will be given of the construction of the operating button device 120 as the electronic apparatus according to the present embodiment.

FIG. 2 is an exploded perspective view showing an upper side of the operating button device 120 appearing in FIG. 1. FIG. 3 is an exploded perspective view showing a back side of the operating button device 120 appearing in FIG. 1. FIG. 4 is a sectional view showing the operating button device 120 appearing in FIG. 1.

In FIGS. 2 to 4, reference numeral 121 denotes a cross key unit. The cross key unit 121 is comprised of a cross key 122, a center button 124, and an operating member holding mat 125. The center button 124 is positioned and held by inserting three projections 124*a*, 124*b*, and 124*c* into holding holes 125*a*, 125*b*, and 125*c*, respectively, formed in the operating member holding mat 125. The center button 124 is provided with an embossed pin 124*d*, which is formed in such a manner as to project from the main body of the center button 124 and serves as a pressing member exclusively for the metallic dome sheet 132. The embossed pin 124*d* is inserted into a hole 125*d* formed at the center of the operating member holding mat 125.

A cross key cap 123 for decoration is bonded and fixed to the cross key 122, and the cross key cap 123 and the cross key 122 constitute one operating button. The cross key 122 is bonded and fixed to the operating member holding mat 125, which is comprised of silicon rubber or the like, by a two-sided tape 126, so that the cross key 122 returns in conjunction with the center button 124 to a neutral position. The two-sided tape 126 is a special-purpose tape with one side thereof having adhesive force with respect to silicon. The front side and the back side of the two-sided tape 126 are comprised of different adhesive materials, and a notch 126*a* is formed in the two-sided tape 126 so that a person who assembles can easily differentiate between the front side and the back side of the two-sided tape 126. The operating member holding mat 125 lies in abutment with the peripheral edge of the cross key 122, and the cross key 122 is positioned by the area of abutment so as to prevent decentering thereof.

Further, the cross key 122 is comprised of ten embossed pins 122*a* and one half column-shaped rib 122*b*, which are formed on the same circumference of a circle in such a manner as to project from the main body of the cross key 122. The embossed pins 122*a* and the half column-shaped rib 122*b* are inserted into holes 125*e* formed on the same circumference in the operating member holding mat 125, so that the embossed pins 122*a* and the half column-shaped rib 122*b* are inhibited from rotating. It should be noted that one of the holes 125*e* formed in the operating member holding mat 125 is shaped so that the half column-shaped rib 122*b* can be inserted into that hole 125*e*. Since the half column-shaped rib 122*b* is formed in the cross key 122 and one of the holes 125*e* formed in the operating member holding mat 125 has a shape corresponding to the half column-shaped rib 122*b*, the positions of the cross key 122 and the operating member holding mat 125 are uniquely determined.

Also, as shown in FIG. 2, under the cross key 122 and the center button 124, an analog switch 131 is placed on top of the metallic dome sheet 132. At the time of operation of the operating button device 120, the embossed pins 122*a* and the half columns-shaped rib 122*b* of the cross key 122 and the embossed pin 124*d* of the center button 124 come into contact with the analog switch 131 and subsequently press metallic domes 132*a*, described later. Thus, at the same depressed point, two kinds of switch input are made to the camera.

The analog switch 131 has a two-dimensional coordinate system that defines coordinate values corresponding to positions at which the embossed pin 122*a* or the half column-shaped rib 122*b* comes into contact with the analog switch 131, and input values of the analog switch 131 vary depending on coordinate values of depressed positions. Inserting a connecting portion 131*f* of the analog switch 131 into a connector 65 mounted on the operation flexible wiring board 61 brings the analog switch 131 into electric conduction. The metallic dome sheet 132 is comprised of five metallic domes 132*a*, which are bonded to the metallic dome sheet 132 by adhesive sheets. The metallic dome sheet 132 brings contact patterns 64 provided on the operation flexible wiring board 61 into conduction by inverting the metallic domes 132*a*, thereby functioning as a switch.

In the present embodiment, positioning bosses 21*c* and 21*d*, which are extended from the battery case 21 so as to position and fix the operation flexible wiring board 61 to the battery case 21, double as positioning members for the metallic dome sheet 132. This minimizes the displacement of the operation flexible wiring board 61 and the metallic dome sheet 132.

Figure 5:
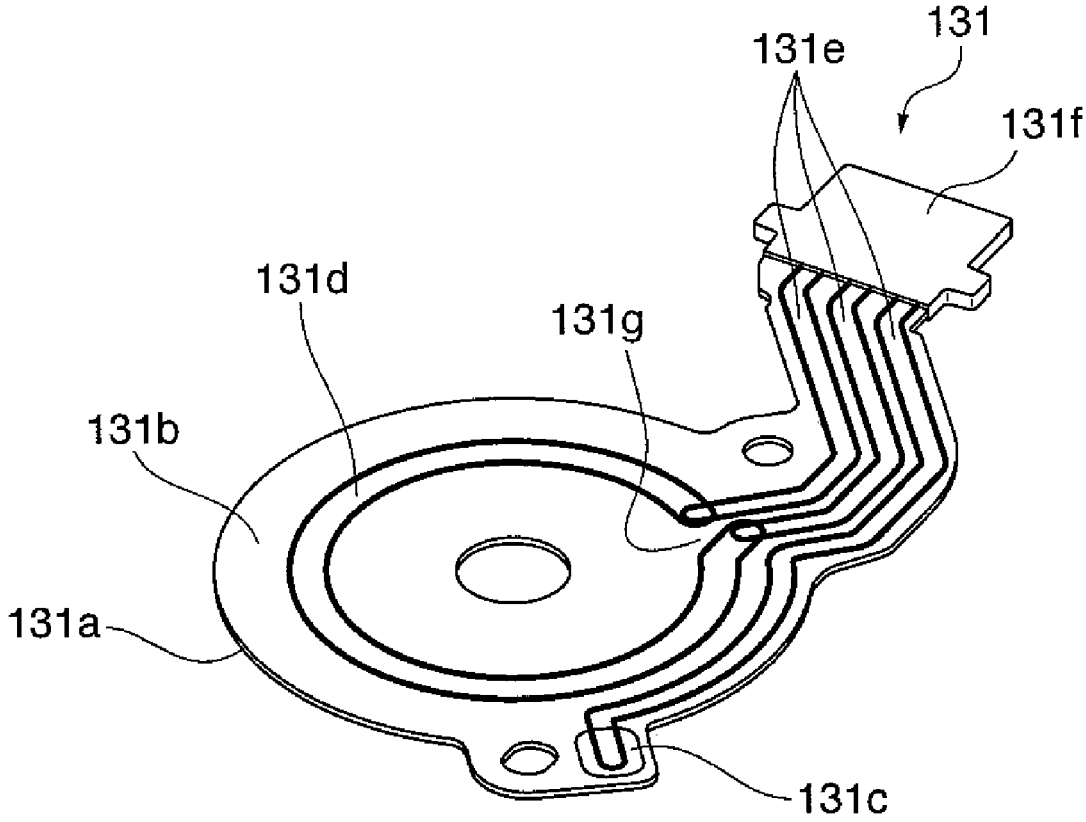
FIG. 5 is an external exploded perspective view showing an analog switch appearing in FIG. 1.

Referring next to FIG. 5, a detailed description will be given of the construction of the analog switch 131.

FIG. 5 is an external perspective view showing the analog switch 131 appearing in FIG. 2.

As shown in FIG. 5, The analog switch 131 includes a metallic plate 131*a* and a flexible wiring board 131*b* arranged to be spaced from the metallic plate 131*a*. The analog switch 131 is a switch member that is configured as an integral unit of the flexible wiring board 131*b* and the metallic plate 131*a* by thermocompression bonding. A carbon-printed portion 131*c* subjected to carbon printing is formed on the flexible wiring board 131*b*. The carbon-printed portion 131*c* is subjected to conductive bonding with an ACF (Anisotropic Conductive Film), so that the carbon-printed portion 131*c* and the metallic plate 131*a* are surely kept in conduction. Further, three-terminal patterns 131*e* and a carbon-printed portion 131*d* shaped like the circumference of a circle are formed on the flexible wiring board 131*b*.

When any of the embossed pins 122*a* and the half column-shaped rib 122*b* of the cross key 122 depresses a certain point on the carbon printed portion 131*d* on the same circumference, a minute gap between the flexible wiring board 131*b* and the metallic plate 131*a* at the depressed point disappears. At this time, the carbon printed portion 131*d* and the metallic plate 131*a* at the depressed point become shorted due to the presence of the carbon printed portion 131*c* with the ACF bonded thereto, so that a certain resistance value can be input to a system, not shown. On this system, a coordinate position of the depressed point is read from the resistance value corresponding to the depressed point, so that a signal corresponding the depressed point of the cross key 122 is output. It should be noted that the positions of the analog switch 131, cross key 122, and operating member holding mat 125 are determined so that the half column-shaped rib 122*b* can come into contact with a break in the circumferential shape of the carbon printed portion 131*d*. Thus, it is possible to avoid the situation in which, a pin comes into contact with a break in the circumferential shape of the carbon printed portion 131*d* to inhibit the output of a signal from the analog signal even though the cross key 122 is operated.

The analog switch 131 is turned on in response to bending of the flexible wiring board 131*b*. Thus, the analog switch 131 can be activated with a smaller load as compared with the switch of the metallic dome sheet 132 that cannot be turned on unless the metallic dome sheets 132*a* are inverted. Thus, when a certain point of the cross key 122 is depressed, the analog switch 131 is turned on before the switch of the metallic dome sheet 132 is turned on.

Since the metallic dome sheet 132 is comprised of only five metallic domes 132*a*, the metallic dome sheet 132 is applied to central, upper, lower, right, and left buttons of the cross key unit 121. Also, depressed positions on the analog switch 131 are continuous. Specifically, in the case where the embossed pins 122*a* and the half column-shaped rib 122*b* are provided only at positions corresponding to the five metallic domes 132*a*, continuous input using the analog switch 131 cannot be satisfactorily performed. To cope with this, the embossed pins 122*a* and the half column-shaped rib 122*b* are provided at positions where there are no metallic domes 132*a*.

The analog switch 131 is positioned by the positioning bosses 21*c* and 21*d* of the battery case 21. As described above, the positioning bosses 21*c* and 21*d* position both the operation flexible wiring board 61 and the metallic dome sheet 132, and this minimizes the relative displacement of the operation flexible wiring board 61 and the metallic dome sheet 132 and the analog switch 31. Also, as described above, the positioning bosses 21*c* and 21*d* are extended from the battery case 21, not from the metallic chassis 4. This is because metallic bosses extended from the metallic chassis 4 would cause electrical shorting since the metallic plate 131*a* as a component of the analog switch 131 is a current-carrying part.

In the description of the present embodiment, the analog switch 131 and the metallic dome sheet 132 of which resistance values vary depending on depressed points were given as examples of the switch means. The switch means, however, should not necessarily be them, but any other switch means such as a pressure-sensitive switch that detects depression pressure, an electrostatic switch that detects static electricity, and a tactile switch can easily be applied to the present embodiment.

According to the present embodiment, the operating button device 120 is constructed such that the two kinds of switches, i.e. the analog switch 131 and the metallic dome sheet 132 are overlapped in the direction in which the cross key 122 and the center button 123 are pressed. At the time of operation, the analog switch 131 and the metallic dome sheet 132 are pressed by the embossed pins 122*a* and the half column-shaped rib 122*b* of the cross key 122 and the embossed pin 124*d* of the center button 124 without the medium of a rubber member or the like. Thus, at the same depressed point, two kinds of switch input are made to the camera.

As described above, when the embossed pins 122 and the half column-shaped rib 122*b* projected from the cross key 122 press the analog switch 131 and the metallic dome sheet 132*a*, the analog switch 131 and the metallic dome sheet 132*a* are not pressed via a rubber member or the like, which would seriously impair a click feeling. Similarly, when the embossed pin 124*d* projected from the center button 124 presses the metallic domes 132*a*, the metallic domes 132*a* are not pressed via a rubber member or the like, which would seriously impair a click feeling. With this arrangement, when an operator depresses the operating button device 120, he/she can reliably confirm operation without impairment of a click feeling. Also, the analog switch 103 and the metallic dome sheet 132 can be arranged without increasing the space for the operating button device 120, and other switches can be added.

Also, the operating member holding mat 125 positions and holds the cross key 122 and the center button 124. Thus, the cross key 122 and the center button 124 can return to the neutral position without causing impairment of a click feeling, and decentering of the cross key 122 and the center button 124 with respect to the exterior can be prevented with ease.

Further, even in the case where the number of input points on the metallic dome sheet 132 is larger than the number of input points on the analog switch 103, the operating button device capable of multi-inputs can be implemented without impairing the advantages of respective input methods using the metallic dome sheet 132 and the analog switch 103.

Further, the analog switch 103 can be turned on with a smaller load as compared with the metallic dome sheet 132, and therefore, by controlling operational load, it is possible to provide control such that only the analog switch 103 is turned on and the metallic dome sheet 132 is not turned on.

This application claims the benefit of Japanese Patent Application No. 2006-032412 filed Feb. 9, 2006, which is hereby incorporated by reference herein in its entirety.

What is claimed is:

1. An electronic apparatus comprising:

a first operating member including a first projection;

a second operating member including a plurality of second projections, said second operating member being disposed so as to surround said first operating member;

a holding member that elastically holds said first operating member and said second operating member, said holding member including a plurality of holes into which respective ones of the first projection and the plurality of second projections is insertable; and a first switch that is overlapped on said holding member and outputs a signal when one of the plurality of second projections comes into direct contact with said first switch in response to operation of said second operating member.

2. An electronic apparatus according to claim 1, further comprising a second switch that is overlapped on said first switch and outputs a first signal when the first projection comes into direct contact with said second switch in response to operation of said first operating member and outputs a second signal when one of the plurality of second projections comes into contact with said second switch via said first switch in response to operation of said second operating member, said second switch outputting a second signal after said first switch outputs a signal.

3. An electronic apparatus according to claim 2, wherein said second switch includes a dome portion that becomes elastically deformed, and the first projections coming into direct contact with the dome portion causes the dome portion to become elastically deformed and any of the plurality of second projections coming into contact with the dome portion via said first switch causes the dome portion to become elastically deformed.

4. An electronic apparatus according to claim 1, wherein said holding member elastically holds said first operating member and said second operating member in an unoperated state, and said operating member is operated against elastic force of said holding member.

5. An electronic apparatus according to claim 1, wherein said first switch includes a metallic plate and a carbon layer arranged to be spaced from the metallic plate, and any of the plurality of projections coming into contact with the carbon layer brings the metallic plate and the carbon layer into contact with each other so that a signal is output.

6. An electronic apparatus according to claim 5, wherein said first switch outputs different signals depending on positions at which the metallic plate and the carbon layer are in contact with each other.

7. An electronic apparatus according to claim 5, wherein said operating member includes a rib-shaped portion formed in alignment with the plurality of projections, the carbon layer includes a carbon portion shaped like a circumference of a circle, and said operating member is disposed so that the rib-shaped portion comes into contact with a break in the circumferential shape of the carbon portion.

* * * * *